US010589287B2

(12) United States Patent
Harman et al.

(10) Patent No.: US 10,589,287 B2
(45) Date of Patent: Mar. 17, 2020

(54) SYSTEMS AND METHODS FOR OIL FIELD SOLID WASTE PROCESSING FOR RE-INJECTION

(71) Applicant: NGL SOLIDS SOLUTIONS, LLC, Denver, CO (US)

(72) Inventors: Robert Harman, Troutville, VA (US); Terry Bailey, Center, TX (US); Justin White, McAlester, OK (US); Dustin Bailey, Center, TX (US); Luke Garrett, Joaquin, TX (US)

( * ) Notice: Subject to any disclaimer, the term of this patent is extended or adjusted under 35 U.S.C. 154(b) by 805 days.

(21) Appl. No.: 14/796,073

(22) Filed: Jul. 10, 2015

(65) Prior Publication Data

US 2017/0009557 A1 Jan. 12, 2017

(51) Int. Cl.

| | |
|---|---|
| ***B02C 23/14*** | (2006.01) |
| ***B02C 23/20*** | (2006.01) |
| ***E21B 43/40*** | (2006.01) |
| ***E21B 41/00*** | (2006.01) |

(52) U.S. Cl.

CPC ..... *B02C 23/14* (2013.01); *B02C 23/20* (2013.01); *E21B 41/0057* (2013.01); *E21B 43/40* (2013.01)

(58) Field of Classification Search

CPC ..... B02C 23/14; B02C 23/20; E21B 43/40; E21B 41/0057

USPC ..... 241/23, 21, 80, 97; 209/12.1

See application file for complete search history.

(56) References Cited

U.S. PATENT DOCUMENTS

| | | | | |
|---|---|---|---|---|
| 398,068 | A | 2/1889 | McEwan | |
| 1,693,885 | A | 12/1928 | Butterworth | |
| 1,838,634 | A | 12/1931 | Peterson et al. | |
| 1,857,766 | A | 5/1932 | Peterson | |
| 2,116,935 | A | 5/1938 | Richard et al. | |
| 2,375,513 | A | 5/1945 | Bach | |
| 2,845,091 | A | 7/1958 | Neer | |
| 2,845,934 | A | 8/1958 | Richard | |
| 2,858,836 | A | 11/1958 | Geh et al. | |
| 2,964,512 | A * | 12/1960 | Goins | C08F 6/003 159/16.3 |
| 3,002,468 | A | 10/1961 | Williams | |
| 3,022,792 | A | 2/1962 | Perkins | |
| 3,046,163 | A | 7/1962 | Kearney et al. | |
| 3,104,672 | A | 9/1963 | Holdren | |

(Continued)

FOREIGN PATENT DOCUMENTS

| | | |
|---|---|---|
| CA | 2366079 | 6/2003 |
| CN | 2350522 | 11/1999 |

(Continued)

OTHER PUBLICATIONS

Co-Pending U.S. Appl. No. 15/214,550, filed Jul. 20, 2016.
Co-Pending U.S. Appl. No. 14/796,006, filed Jul. 10, 2015.
Co-Pending U.S. Appl. No. 14/796,043, filed Jul. 10, 2015.

*Primary Examiner* — Shelley M Self
*Assistant Examiner* — Smith Oberto Bapthelus
(74) *Attorney, Agent, or Firm* — Josephine Brosas; Lewis Brisbois Bisgaard & Smith LLP

(57) ABSTRACT

Systems and methods for processing solid wastes from oil field operations including removal of wastes from oil tanks by a washout and vacuum conveyance system to form a slurry containing solid particles, solid particle size reduction by one or more grinders and, optionally, high velocity transport through recirculation circuits and disposal by injection into a subterranean formation.

33 Claims, 4 Drawing Sheets

(56) References Cited

U.S. PATENT DOCUMENTS 3,394,761 A 7/1968 Jackson, Jr. et al.
3,420,444 A 1/1969 Gunnar
3,556,407 A 1/1971 Hiroshi et al.
3,599,871 A 8/1971 Ruppel et al.
3,645,452 A 2/1972 Stoeckel et al.
3,741,808 A 6/1973 Stalker
3,746,023 A 7/1973 Smith
3,837,399 A * 9/1974 Allen ..... E21B 43/16 166/266
3,856,334 A 12/1974 Lange
4,106,950 A 8/1978 Grismer
4,144,901 A 3/1979 Stevenson
4,207,965 A 6/1980 Chiang-Cheng et al.
4,220,170 A 9/1980 Hebert et al.
4,232,738 A * 11/1980 Yen ..... C09K 8/584 166/266
4,244,523 A 1/1981 Looper
4,351,478 A 9/1982 Looper
4,413,785 A 11/1983 Engelbert et al.
4,453,864 A 6/1984 Beck et al.
4,557,636 A 12/1985 Beck et al.
4,574,825 A 3/1986 Haug
4,660,678 A 4/1987 Krag
4,668,358 A 5/1987 Ball
4,672,710 A 6/1987 Urbani
4,725,362 A * 2/1988 Dugat ..... B01D 37/00 210/710
4,751,887 A * 6/1988 Terry ..... F23G 5/16 110/211
4,753,268 A 6/1988 Palau
4,890,673 A * 1/1990 Payne ..... B09C 1/005 166/266
4,941,493 A 7/1990 Wieringa
4,942,929 A * 7/1990 Malachosky ..... B03B 9/00 175/206
4,957,188 A 9/1990 Bavis
4,994,169 A * 2/1991 Godino ..... C10B 55/00 196/104
5,033,490 A 7/1991 Wade et al.
5,048,775 A 9/1991 Hungerford
5,058,612 A 10/1991 Winsted
5,096,047 A 3/1992 Morikiyo et al.
5,107,879 A 4/1992 Harvey
5,109,933 A 5/1992 Jackson
5,129,469 A * 7/1992 Jackson ..... B09B 1/008 175/206
5,195,548 A 3/1993 Roger
5,226,749 A 7/1993 Perkins
5,303,786 A * 4/1994 Prestridge ..... E21B 21/066 175/206
5,306,351 A * 4/1994 Anderson ..... B01F 17/0085 134/22.18
5,310,285 A * 5/1994 Northcott ..... B09B 1/008 166/305.1
5,337,966 A 8/1994 Francis et al.
5,344,570 A 9/1994 McLachlan et al.
5,352,298 A 10/1994 Moulder
5,361,998 A 11/1994 Sirevag et al.
5,402,857 A 4/1995 Dietzen
5,405,223 A 4/1995 Sirevag
5,419,496 A 5/1995 Novak
5,421,903 A * 6/1995 Manabe ..... B08B 9/0933 134/10
5,431,236 A * 7/1995 Warren ..... B03B 9/00 175/66
5,454,662 A 10/1995 Skibitzke et al.
5,518,553 A 5/1996 Moulder
5,526,562 A 6/1996 Kita et al.
5,544,669 A 8/1996 Manabe et al.
5,564,509 A 10/1996 Dietzen
5,589,603 A 12/1996 Alexander et al.
5,638,845 A 6/1997 Oliver et al.
5,685,411 A 11/1997 Zimmerman et al.
5,718,382 A 2/1998 Jaeger
5,720,310 A 2/1998 Moulder
5,734,988 A 3/1998 Alexander et al.
5,740,821 A 4/1998 Arnold
5,839,521 A * 11/1998 Dietzen ..... B63B 27/20 175/66
5,896,871 A 4/1999 Larsen
5,961,438 A 10/1999 Ballantine et al.
5,964,304 A 10/1999 Morrison et al.
6,009,959 A 1/2000 Dietzen
6,021,793 A 2/2000 Moulder
6,106,733 A 8/2000 Wood
6,119,779 A 9/2000 Gipson et al.
6,179,070 B1 * 1/2001 Dietzen ..... B63B 27/20 175/207
6,179,071 B1 1/2001 Dietzen
6,189,613 B1 2/2001 Chachula et al.
6,192,905 B1 2/2001 Mincy et al.
6,213,134 B1 4/2001 Pike
6,213,135 B1 4/2001 Moulder
6,213,227 B1 4/2001 Dietzen
6,321,754 B1 11/2001 Manabe et al.
6,321,860 B1 11/2001 Reddoch
6,345,672 B1 * 2/2002 Dietzen ..... B63B 27/20 175/206
6,378,791 B1 4/2002 Perry et al.
6,435,565 B2 8/2002 Potts et al.
6,488,314 B1 12/2002 Hutter
6,491,173 B1 12/2002 Costa
6,553,901 B2 4/2003 Reddoch
6,585,115 B1 * 7/2003 Reddoch ..... E21B 21/066 175/206
6,910,411 B2 6/2005 Reddoch
6,939,218 B1 9/2005 Holland
6,953,097 B2 10/2005 Seyffert
6,988,677 B2 1/2006 Sodemann et al.
7,089,949 B1 8/2006 Rogerson et al.
7,104,220 B1 9/2006 Mack et al.
7,108,143 B1 9/2006 Lin
7,261,109 B2 8/2007 Luke et al.
7,325,629 B2 * 2/2008 Blaschke ..... E21B 21/066 175/205
7,455,066 B2 11/2008 Feddema et al.
7,523,570 B2 * 4/2009 Pobihushchy ..... E02F 3/8816 175/67
7,575,072 B2 8/2009 Reddoch
7,717,474 B2 5/2010 Gray
7,798,218 B2 9/2010 Garstad et al.
7,857,077 B2 12/2010 Reddoch
7,905,683 B2 * 3/2011 Kearney ..... B09B 1/008 405/129.1
8,133,164 B2 * 3/2012 Beebe ..... E21B 21/065 210/200
8,133,328 B2 3/2012 Delaney et al.
8,137,030 B2 3/2012 Kearney
8,316,557 B2 11/2012 Burnett
8,316,963 B2 * 11/2012 Eia ..... B63B 35/44 166/357
8,398,034 B2 3/2013 Lambert et al.
8,424,784 B1 4/2013 Munisteri
8,464,971 B1 6/2013 Munisteri
8,470,139 B2 * 6/2013 Booth ..... B01D 3/06 159/22
8,533,974 B2 9/2013 Burnett
8,584,749 B2 11/2013 Troshko et al.
8,607,894 B2 * 12/2013 McDonald ..... E21B 21/065 166/357
8,757,320 B2 6/2014 Liao
9,440,239 B1 * 9/2016 Horton ..... B03B 9/065
2002/0134554 A1 9/2002 Schrenkel et al.
2003/0135083 A1 * 7/2003 Bruno ..... B09B 1/008 588/250
2003/0192439 A1 10/2003 Reddoch
2003/0223850 A1 12/2003 Hendriks et al.
2005/0077299 A1 4/2005 Cheng et al.
2005/0199269 A1 9/2005 Heil et al.
2005/0229954 A1 10/2005 Rosselott et al.
2006/0016760 A1 * 1/2006 Bozak ..... C10G 1/047 210/708

(56) References Cited

U.S. PATENT DOCUMENTS

| | | | | |
|---|---|---|---|---|
| 2006/0065292 | A1 | 3/2006 | Moore | |
| 2007/0120665 | A1 | 5/2007 | Martin et al. | |
| 2008/0083566 | A1 | 4/2008 | Burnett | |
| 2008/0129039 | A1 | 6/2008 | Gray | |
| 2009/0078647 | A1 | 3/2009 | Frazier et al. | |
| 2009/0194280 | A1* | 8/2009 | Gil | E21B 41/0064 166/267 |
| 2010/0025497 | A1 | 2/2010 | Ellenbecker | |
| 2010/0040439 | A1 | 2/2010 | Temple et al. | |
| 2010/0154828 | A1 | 6/2010 | Green | |
| 2010/0236580 | A1* | 9/2010 | Delaurentiis | B08B 3/04 134/26 |
| 2010/0301147 | A1* | 12/2010 | Harkess | A61L 11/00 241/23 |
| 2011/0047743 | A1 | 3/2011 | Shepherd | |
| 2011/0114138 | A1 | 5/2011 | Bastuji et al. | |
| 2011/0246162 | A1 | 10/2011 | Brown et al. | |
| 2011/0284031 | A1 | 11/2011 | Green | |
| 2012/0000495 | A1 | 1/2012 | Schmit et al. | |
| 2012/0186491 | A1* | 7/2012 | Cuypers | C03B 3/02 106/439 |
| 2012/0260945 | A1 | 10/2012 | Kim et al. | |
| 2013/0057132 | A1 | 3/2013 | Flowers et al. | |
| 2013/0067762 | A1 | 3/2013 | Burnett | |
| 2013/0160989 | A1 | 6/2013 | Durden | |
| 2013/0213674 | A1 | 8/2013 | Williams et al. | |
| 2013/0213893 | A1* | 8/2013 | Posa | C02F 1/004 210/651 |
| 2013/0247939 | A1 | 9/2013 | Chanthavongsy et al. | |
| 2014/0190517 | A1* | 7/2014 | Fallon | B08B 9/0933 134/18 |
| 2017/0009557 | A1* | 1/2017 | Harman | B02C 23/20 |

FOREIGN PATENT DOCUMENTS

| | | | |
|---|---|---|---|
| CN | 201125043 | | 10/2008 |
| CN | 201711322 | U | 1/2011 |
| CN | 201728211 | U | 2/2011 |
| CN | 202162184 | U | 3/2012 |
| CN | 202199558 | U | 4/2012 |
| EP | 0041855 | A1 | 12/1981 |
| EP | 1437184 | B1 | 8/2012 |
| EP | 1686883 | B1 | 11/2012 |
| EP | 2512958 | B1 | 5/2013 |
| KR | 20040037631 | A | 5/2004 |
| WO | 1991016150 | A1 | 10/1991 |
| WO | 1993018864 | A1 | 9/1993 |
| WO | 1994017922 | A1 | 8/1994 |
| WO | 1995014543 | A1 | 6/1995 |
| WO | 1995022415 | A1 | 8/1995 |
| WO | 1997000142 | A1 | 1/1997 |
| WO | 1998016717 | A1 | 4/1998 |
| WO | 1999004134 | A1 | 1/1999 |
| WO | 2002005682 | A2 | 1/2002 |
| WO | 2002044515 | A1 | 6/2002 |
| WO | 2003059540 | A1 | 7/2003 |
| WO | 2008041020 | A1 | 4/2008 |
| WO | 2008113070 | A2 | 9/2008 |
| WO | 2010143060 | A1 | 12/2010 |
| WO | 2012005889 | A1 | 1/2012 |
| WO | 2012082216 | A1 | 6/2012 |
| WO | 2013048252 | A2 | 4/2013 |
| WO | 2014023476 | A1 | 2/2014 |

* cited by examiner

SYSTEMS AND METHODS FOR OIL FIELD SOLID WASTE PROCESSING FOR RE-INJECTION

BACKGROUND OF THE INVENTION

Field of the Invention

The present invention relates to systems and methods for processing solid wastes from oil field operations. More particularly, embodiments of the present invention relates to systems and methods for processing solid wastes that may include or encompass removal of wastes from oil tanks, solid particle size reduction and recovery, and underground disposal.

Description of Related Art

The drilling and production of crude oil and natural gas generates large volumes of solid waste such as drill cuttings, oil-based mud, water-based mud, crude sludge, waste cement, and contaminated soils. The need to dispose of this solid waste represents both a logistics and environmental problem. Typically, this solid waste is disposed of at specialized surface landfills. Alternatively, various systems and processes for processing and/or injecting solid wastes into the earth have been proposed, including those described in International Application Publication No. WO 1999/004134, WO 2010/143060; and U.S. Pat. Nos. 4,942,929; 5,109,933; 5,129,469; 5,303,786; 5,337,966; 5,402,857; 5,405,223; 5,431,236; 5,544,669; 5,589,603; 5,734,988; 6,119,779; 6,179,070; 6,321,860; 7,325,629; 7,523,570; 7,798,218; 8,316,557; and 8,533,974, each of which is incorporated by reference herein in its entirety. However, technical problems remain and there is thus a need for improved methods of disposal of solid wastes from oil field operations.

SUMMARY OF THE INVENTION

Embodiments of the invention include systems and methods for oil field solids processing and disposal. Embodiments provide for off-loading, processing, and disposal of liquefied solid wastes from oil field tanker trucks and frac tanks into a well or underground formation. Particular features of the system are designed to remove and/or reduce the size of particulate matter so that solid waste can be processed in a slurry and injected underground without clogging or damaging the injection pump equipment or clogging pores in the subterranean formation.

Particular embodiments of the invention include a method of processing oil field waste for re-injection, the method comprising:

(i) receiving waste from an oil field waste source;

(ii) separating the waste through a first particle size separator;

wherein first solid particles having a particle size smaller than a particle size threshold are transferred to a first slurry tank, combined with fluid to form a first slurry, and at least a portion of the first slurry is removed and re-circulated back into the first slurry tank, optionally at a velocity sufficient for reducing particle size upon impact of the first solid particles with the first slurry tank;

wherein second solid particles having a size larger than the particle size threshold are transferred to a particle size reduction apparatus, reduced in size, transferred to a second slurry tank, combined with fluid to form a second slurry, and at least a portion of the second slurry is removed and re-circulated back into and, optionally at a velocity sufficient for reducing particle size upon impact with, one or more of the first separator, the particle size reduction apparatus, or the second slurry tank, and ultimately circulated into the first slurry tank;

(iii) removing at least a portion of slurry from the first slurry tank and transferring the removed slurry to a second particle size separator; and (iv) separating the removed slurry into (a) waste solids having a particle size larger than the particle size threshold and into (b) a re-injection slurry comprising particles with a particle size smaller than the particle size threshold.

Particular systems according to embodiments of the invention can include a system for processing oil field waste, the system comprising:

a first particle separator and a second particle separator;

a first slurry tank and a second slurry tank; and a particle size reduction apparatus;

a first pump and a second pump;

a first and a second recirculation circuit and a transfer conduit;

wherein:

the first separator is operably connected to the particle size reduction apparatus and the first slurry tank;

the particle size reduction apparatus is operably connected to the second slurry tank;

the first pump is connected with the first slurry tank and the second particle separator in a manner to provide for re-circulation of slurry back into the first slurry tank through the first recirculation circuit and/or to transfer slurry to the second particle separator from the first slurry tank through the transfer conduit;

the second pump is connected with the second slurry tank, the first particle separator, and/or the particle size reduction apparatus in a manner to provide for re-circulation of slurry back into the second slurry tank, the first particle separator, and/or the particle size reduction apparatus through the second recirculation circuit, and optionally ultimately back into the first particle separator for further processing and circulation into the first slurry tank.

Embodiments of the system may provide a washout fluid source delivered to the tanks for cleaning out solid residues and other contaminants in the interior of tanks. In embodiments, the washout fluid is pumped into the interior of tanks to produce a washout waste. Embodiments of the system may also include a vacuum conveyance system for pulling the washout waste from the tanks. The vacuum conveyance system may comprise a vacuum vessel capable of receiving washout waste, a vacuum pump operably connected to the vacuum vessel and capable of producing negative pressure within the vacuum vessel, and a transfer pump operably connected to the vacuum vessel and capable of transferring washout waste out of the vacuum vessel through positive pressure. Additionally, in some embodiments, liquefied solid wastes are unloaded directly from oil field tanker trucks through an unload pump. Embodiment of the system and process may transfer the washout waste and liquefied solid wastes directly to a filter vessel.

Additional embodiments include a particle size reduction system. The particle size reduction system is designed to reduce the size of solids while keeping them suspended in a slurry. In embodiments, the particle size reduction system may be a separate unit from the other components of the system. Particularly advantageous features of the particle size reduction system include multiple particle classification units or separators. This allows progressive reduction in particle size of solids being processed through the system and allows preparation of the final slurry so that particle sizes are suitably reduced enough in size for injection into porous earth formations. In embodiments, the separators may take the form of a linear motion vibratory shaker having internal screens with predetermined mesh sizes, and the mesh size of the separators may differ or be the same. However, the separators may be other separators known in the art, including other types of filter separators, centrifugal separators such as centrifuges and hydrocyclones, and the like.

The particle classification units or separators may be each operably connected to a slurry tank such that particles less than the mesh size fall through to the slurry tank. In one embodiment, the particle size reduction system has a first and second separator each operably connected to a respective slurry tank. The first separator may be additional operably connected to an apparatus configured for reducing particle size which receives large particles and debris that are withheld by the first separator. In embodiments, the first separator is operably connected to a first slurry tank, the apparatus is operably connected to a second slurry tank, and the second separator is operably connected to a third slurry tank. In an embodiment with two separators, the first separator is configured to be at the input of the particle size reduction system, and the second separator is configured to be near the output. In an embodiment with multiple separators, it is contemplated that the particle size threshold would be reduced along a gradient from the input to the output of the particle size reduction system. Such configuration provides for the step-wise reduction of the size of solid particles so that particles leaving the particle size reduction system are smaller than those entering the system.

The apparatus is configured to reduce large particles to a size that can be passed through the first separator. In embodiments, the apparatus may be a grinder such as a hardened rotary blade crusher, ball mill, hammer mill, or the like. The apparatus may be operably connected to the second slurry tank which receives reduced particles from the apparatus. Additionally, embodiments of the particle size reduction system may include inputs for influx of diluted brine water to dilute the solids content and keep them in suspension and aid in particle size classification. In embodiments, the system and method may operate at locations where dilution fluid is readily available. Additionally, the system of the invention has the particularly advantageous feature of a transportable solids container to hold wet or dry solids that may be recovered from the second particle classification unit or separator. The transportable container allows recovery of larger solid particles resistant to breakdown such that they can be removed from the system. Recovery of these resistant particles allows for more efficient processing of the solids as these particles may accumulate in and impede functioning of other equipment such as separators, slurry pumps, and grinder apparatus. Additional advantageous features may also include a bypass that allows fluids to be transported directly from the filter vessel to the second separator in situation where it's not desirable to pass incoming solids through the apparatus.

Additional aspects of the particle size reduction system may include mechanisms for mixing the fluids in the slurry tanks so that particles remain suspended. These mechanisms may include an agitator, paddle mixer, or the like. Additional aspects may include recirculation of slurry fluids through recirculation circuits operably connecting the first separator, apparatus, and slurry tanks. The recirculation may occur at high velocities to promote additional particle size reduction through impact of the particles with the sides of the vessels and conduits as the fluid is recirculated. The multiple recirculation circuits ensure additional particle size breakdown beyond that resulting from processing by the apparatus. Additional aspects may include one or more transfer conduits for transferring slurry fluids from one or more slurry tanks to one or more separators. Embodiments may employ one or more slurry pumps for recirculating or transferring the fluids, wherein the slurry pumps as operably connected to jet nozzles for high velocity recirculation.

In embodiments, the particle size reduction system may be a self-contained unit that may be connected or disconnected with other components of the system. The particle size reduction system may be contained on vehicle such as a truck or trailer to facilitate transport to oil field sites. The particle size reduction system may have an input for connecting to an oil tank off-load system such as the vacuum conveyance system for receiving unprocessed solid waste and an output for connecting to a positive displacement pump for disposal of the processed solid waste.

In embodiments, the output of the particle size reduction system is transferred to a positive displacement injection pump for disposal of the processed oil field waste into an earth formation or well. The positive displacement injection pump is configured for pumping fluids at high volumes and pressures deep into the earth. The earth formation may be loose sandy formations in the earth which serve as a subterranean injection zone. The slurry tank at the output of the particle size reduction system, which in embodiments may be the third slurry tank, is operably connected to the positive displacement injection pump.

Optional components of the system may include one or more surge volume tanks. These include a quick dump tank that provides surge capacity in the event incoming fluid volume exceeds the capacity of the separators and pre-injection tank which provides surge capacity in the event outgoing fluid volume exceeds the capacity of the positive displacement injection pump. These and other features and their advantages will be apparent in the foregoing detailed description.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention.

DETAILED DESCRIPTION OF VARIOUS EMBODIMENTS OF THE INVENTION

Figure 1:
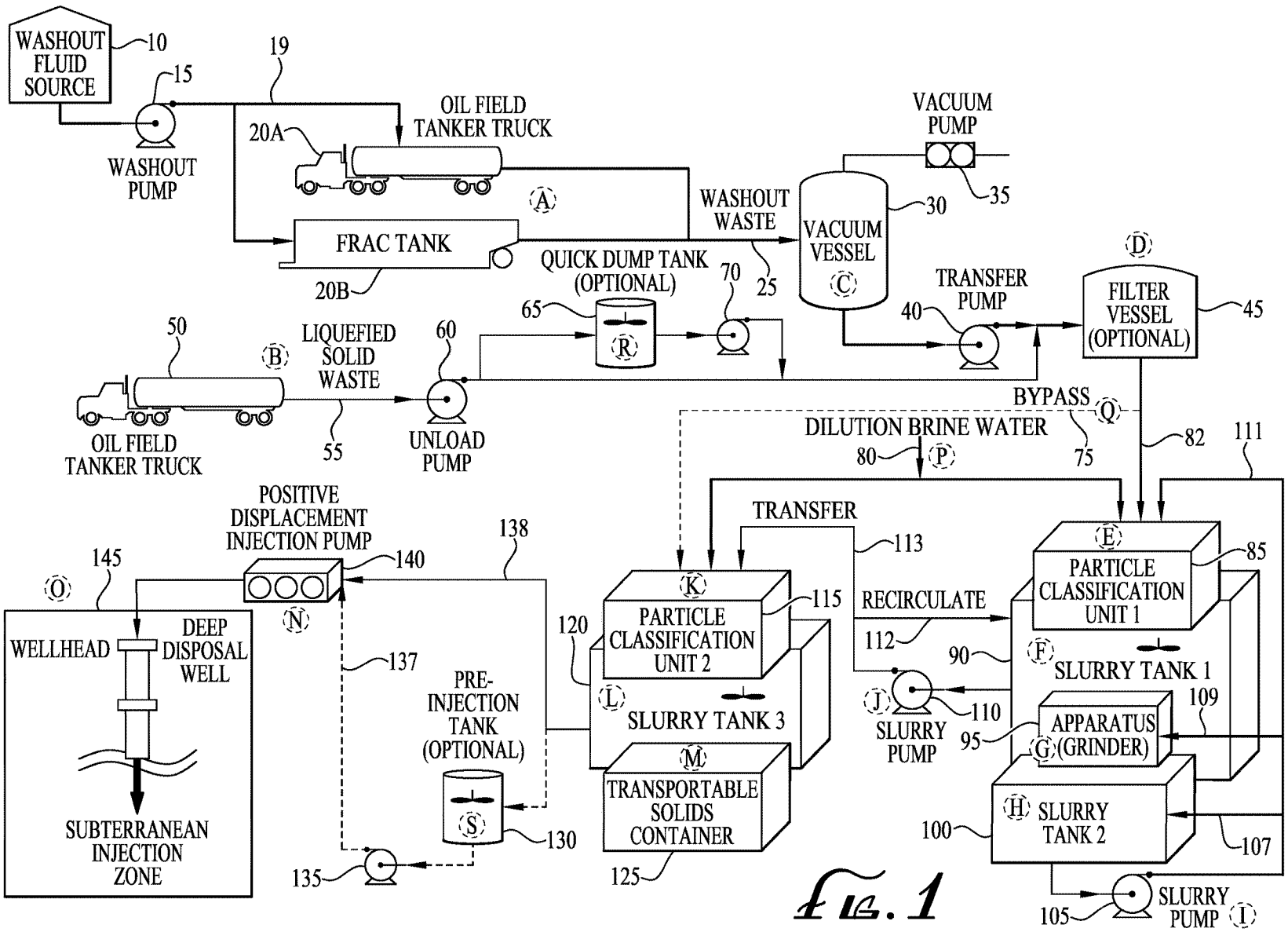
FIG. 1 is a schematic diagram showing a system and process for off-loading, processing, and disposing of oil field solid waste according to an embodiment of the invention.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

In one embodiment, the present invention provides a method of processing oil field waste, in particular with the goal of re-injecting the waste in a deep disposal well with one or more subterranean injection zone. The method may first comprise the step of receiving liquefied or residual waste (such as solid waste in the form of a solid or slurry) from an oil field waste source wherein the solid waste typically comprises solid particles of a range of sizes. The oil field waste source may be any source such as a tank or tanker (e.g., an oil field tanker truck or a frac tank). After the liquefied or residual solid waste is received, the solid waste may be separated through one or more separators (as in at least one separator, two separators, three separators, four separators, five separators, and so on). In one aspect, the one or more separators may be the same kind of separator (e.g., vibratory shaker, column separator, etc.) with each comprising one or more or a variety of particle size thresholds. In another aspect, the one or more separators may each be a different kind of separator with each comprising one or more or a variety of particle size thresholds. In embodiments of the methods described herein, the one or more separators may be configured for separation of waste at any stage (e.g., as in one or more stages) in the processes disclosed.

In a particular aspect, waste may be separated through a first separator based on a particle size threshold. Solid particles having a size below the particle size threshold may be transferred to one or more tanks. In a particular aspect, solid particles having a size below the particle size may be transferred to a first slurry tank. In a particular aspect, a solvent, such as water or brine, may be added to the solid particles to form a slurry in the first slurry tank. In a more particular aspect, solid particles having a size below the particle size are transferred to a first slurry tank and added to diluted brine water to form a first slurry and solid particles having a size above the particle size threshold may be transferred to an apparatus configured to reduce solid particle size, such as a grinder. Additionally, the method may further include causing the apparatus to reduce the size of the solid particles, and then transferring the reduced solid particles from the apparatus to a second slurry tank to form a second slurry. Further, a portion of the first slurry may be recirculated to and from the first slurry tank and a portion of the second slurry may be recirculated to and from the second slurry tank at a velocity sufficient for reducing solid particle size via impact within the first slurry tank and second slurry tank.

In additional embodiments, a portion of the second slurry is recirculated back to the apparatus and the separator. Additionally, a portion of the first slurry from the first slurry tank may be transferred to a second separator having a particle size threshold which may be the same or different than that of the first separator. The portion of the first slurry may be separated through the second separator based on the particle size threshold of the second separator, wherein solid particles having a size below the particle size threshold of the second separator are transferred to a third slurry tank to form a third slurry and solid particles having a size above the particle size threshold are transferred to a transportable container. The transportable container is particularly advantageous in allowing recovery of the portion of the solid waste entering the system that has larger sized particles resistant to mechanical breakdown. Recovery of these resistant particles prevents their accumulation into other equipment such as slurry pumps, grinders, and separators, which can cause them to operate less efficiently or break down. The resistant solids are removed from the system for off-site disposal. In embodiments, the average particle size of the solids in the slurry of the first slurry tank and/or the second slurry tank is greater than the average particle size of solids in the third slurry tank. Multiple slurry tanks of the invention may hold progressively smaller particles as solids are processed through the system, wherein the last slurry tank holds particles sized appropriately for subterranean disposal.

In embodiments, all or a portion of the oil field waste is transferred directly to the second separator instead of the first separator. Optionally, the oil field waste may be passed through a magnetic filter before separation through the first separator, wherein the magnetic filter is capable of removing ferrous materials through magnetic attraction. Further, the first particle size thresholds of the separators may be in the range of 200 to 500 μm. Thus the particle size of the final processed slurry, ready for disposal into a well, is in the range of 200 to 500 μm.

In embodiments, the system may include a third separator, a fourth slurry tank holding a fourth slurry, and a second transportable solids container.

In embodiments, a portion of the third slurry and/or fourth slurry (otherwise referred to as the re-injection slurry) is transferred to a positive displacement injection pump capable of pumping the portion of the third slurry and/or fourth slurry into a subterranean injection zone. Further, a fluid, such as a solvent (e.g., dilution brine water) may be transferred to at least one of the first separator, second separator, and/or third separator and second slurry tank to aid in particle size classification and form slurries of proper density in the slurry tanks.

In embodiments, the oil field waste from the oil field tanker truck or frac tank is first diluted with a washout fluid prior to separation. Diluted oil field waste may be removed from the oil field tanker truck or frac tank by negative pressure which is produced by a vacuum conveyance system. Included in embodiments is a method of offloading an oil tanker truck, comprising: transferring contents out of the oil tanker truck by way of negative pressure through a vacuum conveyance system, the vacuum conveyance system comprising: a vacuum vessel capable of receiving washout waste; a vacuum pump operably connected to the vacuum vessel and capable of producing negative pressure within the vacuum vessel; and a transfer pump operably connected to the vacuum vessel and capable of transferring washout waste out of the vacuum vessel through positive pressure.

In embodiments, some or all of the portion of the third slurry is transferred to one or more surge volume tanks when the capacity of the positive displacement injection pump is exceeded. In a particular aspect, some or all of the oil field waste is transferred to a surge volume tank when the capacity of the first separator is exceeded.

An additional embodiment provides a method of removing residual solid waste for an oil field tanker truck or frac tank. The method may comprise providing an oil field tanker truck or frac tank containing residual solid waste, providing a washout fluid source, transferring the washout fluid to the oil field tanker truck or frac tank via a washout pump to yield a washout waste comprising diluted residual solid waste, and transferring the washout waste out of the oil field tanker truck or frac tank through negative pressure produced by a vacuum conveyance system. In embodiments, the vacuum conveyance system may comprise one or more vacuum vessels capable of receiving washout waste, one or more vacuum pumps operably connected to the one or more vacuum vessels and capable of producing negative pressure within the one or more vacuum vessels, and one or more transfer pumps operably connected to the one or more vacuum vessels and capable of transferring washout waste out of the one or more vacuum vessels through positive pressure. Optionally, the washout waste may be transferred from the vacuum vessel to one or more magnetic filters capable of removing ferrous materials through magnetic attraction.

An additional embodiment provides a system for processing oil field waste. The system may comprise a first separator and second separator (which may otherwise be referred to as particle classification units) each comprising a screen having a mesh size capable of separating solid particles from oil field waste, the screen operably connected to a mechanism capable of inducing vibration in the screen. The system may further comprise a first slurry tank and second slurry tank each comprising a mechanism capable of keeping the solid particles in suspension. Additional components of the system may include an apparatus capable of reducing the size of the solid particles, a first pump and a second pump, a first and second recirculation circuit and a transfer conduit. In embodiments, the mesh size (i.e., the diameter of the holes of the mesh) of the second separator may be the same or smaller than the mesh size of the first separator. The first separator may be directly or indirectly operably connected to the particle size reduction apparatus (e.g., grinder) and the first tank (e.g., first slurry tank), and the particle size reduction apparatus may be directly or indirectly operably connected to the second tank (second slurry tank). The first pump may recirculate slurry to and from the first slurry tank through the first recirculation circuit and transfer slurry to the second separator from the first slurry tank through the transfer conduit. Further, the second pump may recirculate slurry to and from the second tank to and from one or more of the first separator, the grinder, and the second slurry tank through the second recirculation circuit and ultimately circulates slurry processed by any one or more of the first separator, the grinder, and the second slurry tank into the first slurry tank.

Additional embodiments of the system may comprise a third slurry tank and a transportable container, wherein the second separator is directly or indirectly operably connected to the third tank and transportable container. The transportable container allows particles resistant to breakdown to be recovered from the system, thereby preventing clogging of separators, pumps, and the grinder apparatus. The container can also be fixed or stationary, but a transportable container allows for greater convenience in hauling the waste away. Further, a positive displacement injection pump may be directly or indirectly operably connected to the third slurry tank. Additional embodiments may optionally comprise a magnetic filter. In embodiments, any one or more of the separators can be directly or indirectly operably connected to a magnetic filter and a vacuum conveyance system, wherein the vacuum conveyance system is operably connected to the magnetic filter. In preferred embodiments, magnets or a magnetic filter can be incorporated in a particle classification unit, such as PCU1, and/or the grinder. The vacuum conveyance system may comprise one or more of a vacuum vessel capable of receiving washout waste, a vacuum pump operably connected to the vacuum vessel and capable of producing negative pressure within the vacuum vessel, and a transfer pump operably connected to the vacuum vessel and magnetic filter and capable of transferring washout waste out of the vacuum vessel through positive pressure.

Additional embodiments of the system may comprise a bypass conduit, wherein the bypass conduit is a common header that directly allows fluids to be sent to any particle classification unit from the vacuum vessel or magnetic separator (if present). For example, the header can direct the waste into one or more of the first PCU, or the second PCU, or the third PCU. This configuration is especially helpful for high volume processing where incoming tanker volumes are only processed by one of the PCUs or less than all of the PCUs to accommodate simultaneous processing of multiple tanker volumes. Also included in embodiments are one or more surge volume tanks. One embodiment includes a surge volume tank directly operably connected to the third slurry tank for receiving surge volume from the third slurry tank, while another embodiment includes a surge volume tank operably connected to the magnetic filter for receiving surge volume from the first separator. Additional embodiments may also comprise a brine water transfer conduit configured for transferring brine water to at least one of the first separator, second separator, and second slurry tank to aid in dilution of the slurry and facilitate particle size classification. Additionally, a washout fluid source may be included. The washout fluid source may be directly or indirectly operably connected to a washout pump capable of diluting residual solid waste from oil field tankers and frac tanks to provide washout waste. A transfer conduit from an oil field tanker or frac tank to the vacuum vessel may also be included for transporting or transferring washout waste from the oil field tanker or frac tank to the vacuum vessel.

Turning now to the Figures, FIG. 1 shows an embodiment of a system according to the invention. Each facility has provisions to wash residual solid waste from tanker trucks 20A and frac tanks 20B. Clean fresh water or brine 10 is applied under high pressure with washout pump 15 through transfer conduit 19 to thoroughly clean internal surfaces. Effluent 25 from this process is collected under vacuum by a large vacuum vessel 30 operated by vacuum pump 35.

Figure 2:
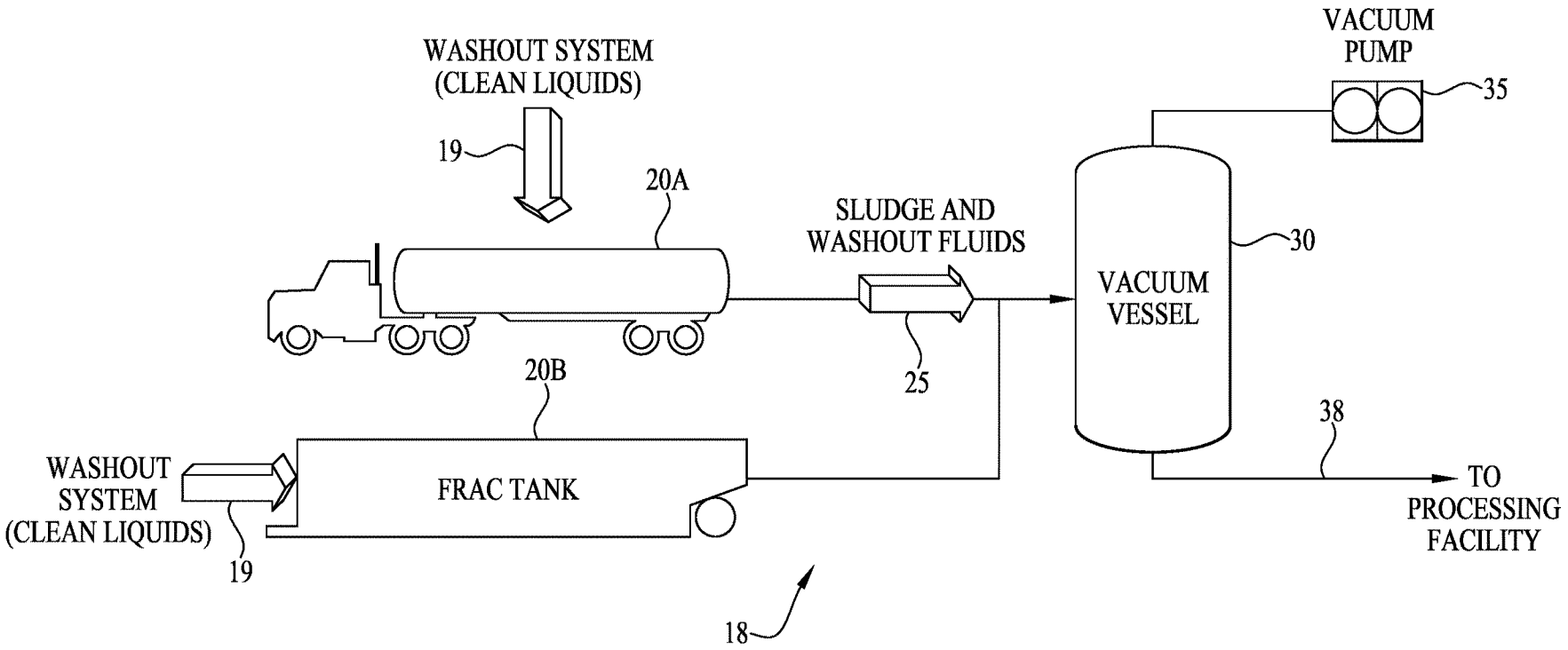
FIG. 2 is a schematic diagram showing a system and process for off-loading oil field waste through a washout and vacuum conveyance system according to an embodiment of the invention.

Oil field tanker trucks 20A haul large volumes of flowable/liquefied solid waste to the facility for disposal. Material within the tankers may contain one or more of the following: solid waste, oil-based mud, water-based mud, drill cuttings, crude oil sludge, cement residue, contaminated soil, production tank bottoms, etc. Shown in FIG. 1 and FIG. 2, oil field tankers 20A and frac tanks 20B desiring cleaning services typically arrive with large volumes of solids/sludge. The available drains on these tanks will typically clog unless a negative pressure (vacuum) is applied during the washout process. In this system, a large vacuum vessel 30 and high volume vacuum pump 35 pull solids and waste liquids 25 out of the tankers/frac tanks. The solids are diluted and mixed with the clean washout fluid 10. When the vacuum vessel is full the diluted fluids are subsequently pumped out or pushed out under positive pressure 38 for post processing. The Vacuum Vessel 30 and a high volume vacuum pump 35 create a negative pressure, and thus the driving force, to pull diluted/liquefied fluids from tankers 20A and frac tanks 20B during the washout cleaning process. The vacuum vessel 30 is sized to handle several hundred barrels of liquid waste. It's designed for full vacuum and pressures up to 20 psi. Pressure can be applied by the vacuum pump to 'blow' fluids out of the vessel.

An optional Filter Vessel 45 receives fluids from either the Vacuum Vessel 30 through a Transfer Pump 40 or liquefied solid waste 55 from oil field tanker truck 50 through Unload Pump 60. It contains a magnetic filter grating assembly designed to remove ferrous materials and very large particles/debris. It's designed for pressure and vacuum, and has a hydraulically actuated cleanout door for ease of access to remove internal debris. However, in other embodiments, the Filter Vessel is not needed, as the particle size reduction apparatus is large enough to handle any particle that may enter the system.

The Particle Classification Unit 1 (PCU 1), or First Separator 85 receives fluids exiting the Filter Vessel 45 (if present), optionally through transfer conduit 82, or directly from the transfer pump 40. PCU1 can be any separator, such as a linear motion vibratory shaker, used to classify the particle size of the solids. Screens internal to the PCU have predetermined mesh sizes. All particles and liquids smaller than the mesh size fall through the PCU screens into First Slurry Tank 90. Remaining material is conveyed to the end, via linear vibratory motion, of the PCU where it falls off into Apparatus 95 which is configured to reduce particle size. This is one of two PCUs in the system. In this embodiment, the screen mesh size is sized such that particles less than 200-500 μm pass fall through. The screen size was chosen to allow the majority of the fluids and particles to pass into Slurry Tank 1 90. Any size screen can be used and appropriately sized for a particular application. Large particles and debris, greater than 500 μm, are optionally dewatered before being conveyed into the Apparatus 95, such as by using a dryer. The screen size can be changed as desired to accommodate varying plant conditions. In embodiments, the screen size of the PCU1 may be anywhere from about 200 to 1000 μm. Dilution Brine Water 80 can be mixed with the incoming fluids and solids in order to dilute the solids content which aids in particle size classification.

First Slurry Tank 90 is a large vessel that holds the fluids and solids that pass through the screens of PCU 1. It can contain several rotary agitators with paddle blades to continuously mix and keep solids suspended in solution. It can also contain a jet line with nozzles to recirculate the fluids at high velocities via Slurry Pump 110. Fluids and solids passing through the jet line and nozzles are at high velocities. This allows for further particle size reduction via continuous impact as the fluid is recirculated through recirculation circuit 112.

The Apparatus 95, a particular size reduction apparatus such as a grinder, provides the energy to reduce the solid particle sizes from up to a couple inches in diameter to a size that can eventually be passed through the screens on PCU 1 85. The Apparatus 95 can be a grinder, hardened rotary blade crusher, ball mill, hammer mill, or the like. Solids entering the Apparatus 95 can be impacted against each other and the container at high speed causing particle size reduction. Magnets can be incorporated into the grinder, for example, disposed internal to the Apparatus feed chute and as such can serve as a secondary method for the removal ferrous materials. Particles of reduced size exit the Apparatus 95 and fall into the Second Slurry Tank 100. Using Slurry Pump 105, slurry from the Second Slurry Tank 100 can be circulated into First Separator 85, Apparatus 95, or re-circulated into Second Slurry Tank 100, such as in continuous circulation loops 109, 111, 107 to aid in the particle size reduction process. Ultimately, the slurry is circulated into Slurry Tank 1 90, typically from PCU 1 85.

The Second Slurry Tank 100 receives the solid particles exiting the Apparatus 95. Dilution Brine Water 80 can be added to the Second Slurry Tank 100 to suspend the solids as a flow-able, pump-able slurry. The Second Slurry Tank 100 contains a jet line with a series of ceramic nozzles. Slurry Pump 105 recirculates fluids at very high velocities from the bottom of the Second Slurry Tank 100 to the Second Slurry Tank's jet line in recirculation circuit 107, as well as recirculation circuits 109 and/or 111. Impact during the recirculation process further reduces the particle size.

Slurry Pump 105 is a specialized pump with hardened wetted surfaces specifically designed for abrasive, solids laden fluids. The function of Slurry Pump 105 in this application is three-fold; Second Slurry Tank 100 recirculation (e.g., continuous), reducing particle size by way of re-introduction into Apparatus 95 fluid port, and/or re-classification of particle size via PCU 1 85. One or more or all of these functions can be simultaneously or sequentially performed.

Slurry Pump 110 is a specialized pump with hardened wetted surfaces specifically designed for abrasive, solids laden fluids. The function of Slurry Pump 110 in this application is two-fold; Slurry Tank 1 90 recirculation (e.g., continuous) in recirculation circuit 112, and transfer to Particle Classification Unit 2 115 in transfer conduit 113. One or more or all of these functions can be simultaneously or sequentially performed.

Particle Classification Unit 2 (PCU 2) or Second Separator 115 receive slurry (e.g., fluids and particles) transferred by Slurry Pump 110 from the First Slurry Tank 90 for final particle size classification. PCU 2 can be identical to PCU 1 including the screen mesh size. In embodiments, the mesh is preferably in the range of 200 μm to 500 μm, and is sized to minimize the particle size injected into the Deep Disposal Well 145. Fluids and particles less than the screen mesh size fall into Third Slurry Tank 120. Remaining materials are conveyed to the end using linear vibratory motion, of the PCU where it falls off into a Transportable Solids Container 125 for offsite disposal. The Transportable Solids Container allows solids resistant to breakdown to be removed from the system. Removal of resistant particles increases the overall efficiency of the system, as these solids can potentially interfere with functioning of other equipment. PCU 2 screen mesh size can be optimized and changed as desired for a specific formation geology or well bore condition. Dilution Brine Water 80 can be added as necessary to optimize the classification process and/or to alter the final solid concentration of the fluid within Third Slurry Tank 120.

Third Slurry Tank 120 is a large vessel that holds fluids and solids that pass through the screens of PCU 2. It contains several rotary agitators with paddle blades to continuously mix and keep solids suspended in solution. Chemicals may be added to this tank to alter fluid characteristics for improved injectability. Chemicals added to the Third Slurry Tank may include viscosifiers non-limiting examples of which include bentonites, montmorillonites, barites, attapulgite, sepiolite, or polymers. Chemicals may also include friction reducers such as polyacrylamide copolymers. Fluid within Third Slurry Tank 120 has particles sufficiently reduced in size so that fluid is ready for injection into the Deep Disposal Well 145 via the Positive Displacement Injection Pump 140. Fluid in Third Slurry Tank 120 may be transferred to Positive Displacement Injection Pump 140 through transfer conduit 138.

Figure 3:
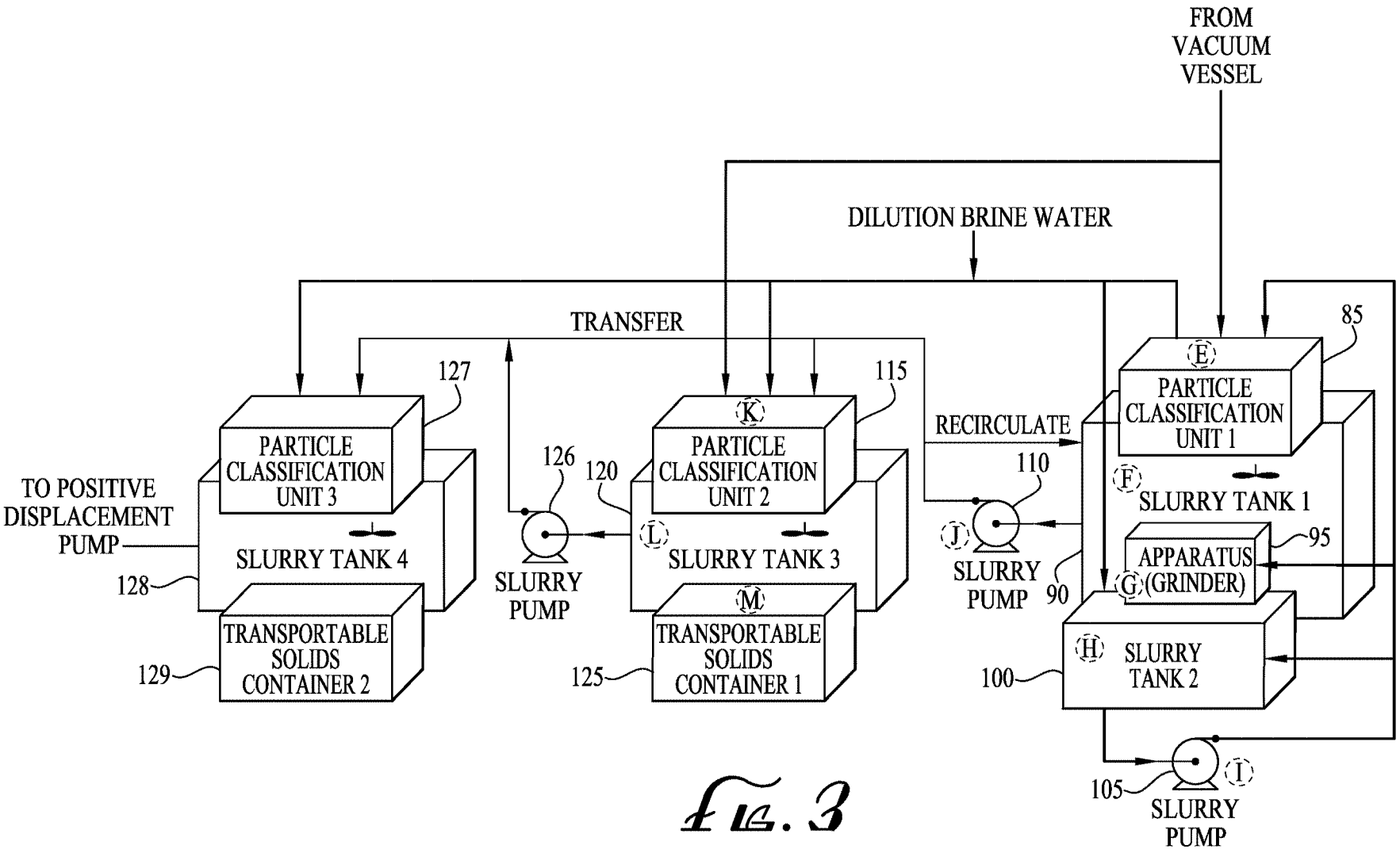
FIG. 3 is a schematic diagram showing a system and process for processing oil field solid waste according to an embodiment of the invention that includes three Particle Classification Units (PCUs) and four slurry tanks.

Another embodiment, shown in FIG. 3 which is limited to showing the PCUs of the system, includes a Third Particle Classification Unit (PCU3) 127, a Fourth Slurry Tank 128, and a Second Transportable Solids Container arranged the same way as PCU2 115, Slurry Tank 3 120, and Transportable Solids Container 125 described above. In embodiments, slurry fluids can be passed from PCU1 85 to either PCU2 115 or PCU3 127, directly or indirectly. For example, FIG. 3 shows slurry fluids passing from First Slurry Tank 90 to PCU2 115 and PCU3 127 through slurry pump 110, or from Third Slurry Tank 120 to PCU3 127 through slurry pump 126. However, in other embodiments, slurry fluids are transferred to the PCUs sequentially, such that PCU1 only transfers slurry fluids to PCU2, and PCU2 only transfers slurry fluids to PCU3. Further, in embodiments, PCU1 85 receives waste fluids directly from vacuum vessel as shown in FIG. 3 rather than through a Filter Vessel. Additionally, in embodiments, slurry fluids pass directly from Fourth Slurry Tank 128 to Positive Displacement Pump as shown in FIG. 3 or alternatively from both Third Slurry Tank 120 and Fourth Slurry Tank 128. A skilled artisan, with the benefit of this disclosure, can appreciate alternative arrangements of the components of the system and circulation between the components that fall within the scope of the invention.

Figure 4:
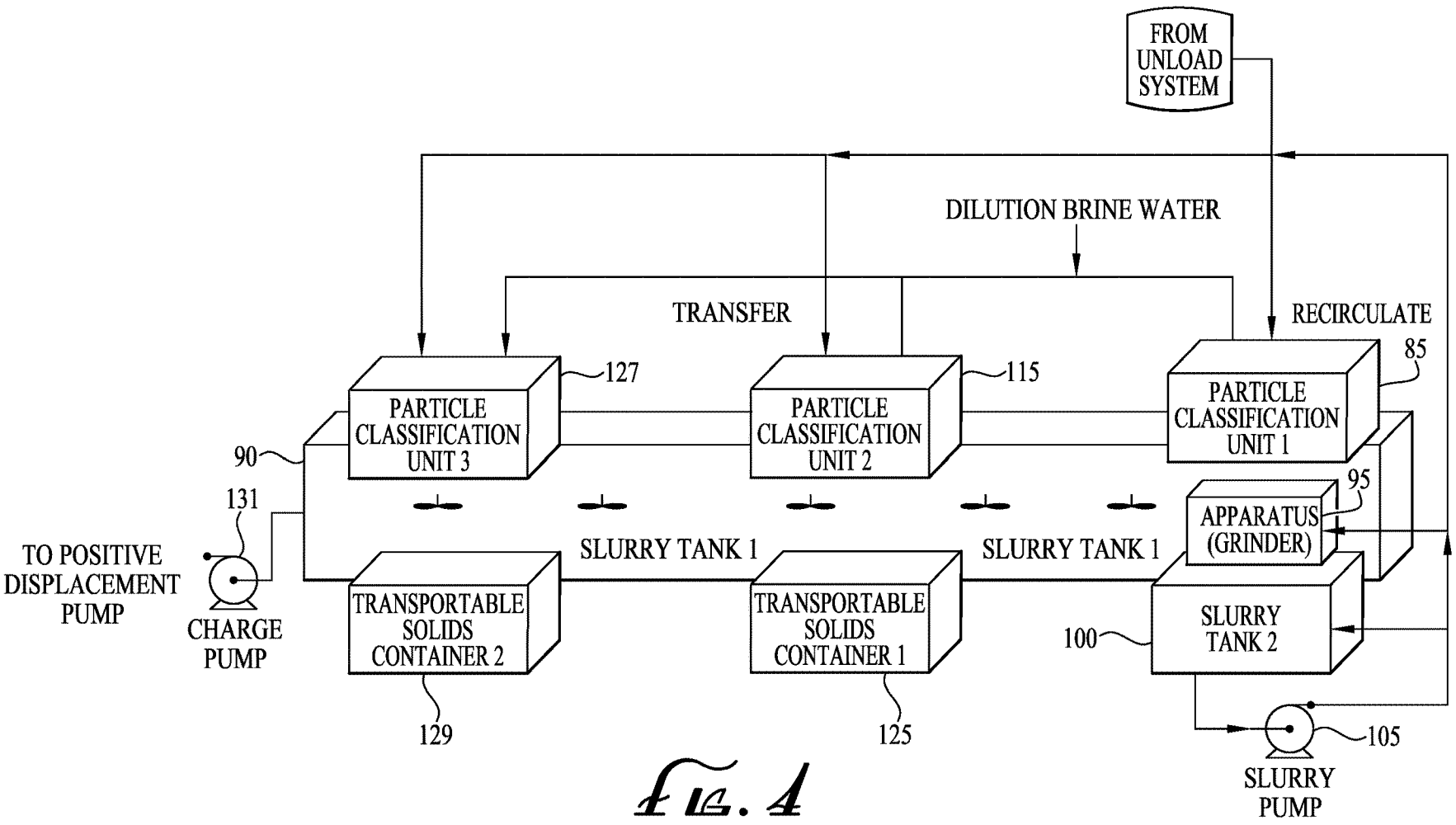
FIG. 4 is a schematic diagram showing a system and process for processing oil field solid waste according to an embodiment of the invention that includes three Particle Classification Units (PCUs) and two slurry tanks.

Another embodiment, shown in FIG. 4, which shows PCUs of an exemplary system, features a three-PCU system (PCU1 85, PCU2 115, and PCU3 127) with one large slurry tank (Slurry Tank 1 90) in communication with (such as under) all three PCUs. The common "feed" header goes to all three PCUs. The primary path, however, is through PCU1 so that the majority of large particles can be reduced in size. If there is a large surge in volume, beyond the capability of PCU1, then fluids are transferred to PCU2 and optionally to PCU3. The additional PCUs are for "ungrindable" solids, increased throughput and redundancy. Further, in this embodiment, all three PCUs have the same size particle size threshold; in other embodiments the thresholds of the PCUs may differ. The second slurry tank (Slurry Tank 2 100) catches the large particles that discharge from PCU1 85 that exceed the particle size threshold of PCU1 and that exit the particle size reduction apparatus 95.

Additionally, still referring to FIG. 4, slurry pump 105 recirculates slurry exiting Slurry Tank 2 100 through a multiple option recirculation loop in the PCU1/grinder subsystem to allow for additional particle size reduction, tank clean up and to keep solids in solution. Further, such recirculation may optionally transfer fluids back to the grinder to be reground to further reduction in particle size and/or back to the main feed header for subsequent particle size reclassification. Further, in this embodiment, processed slurry from Slurry Tank 1 90 is transferred to Charge Pump 131 for transfer to Positive Displacement Pump. Additionally, in this embodiment, the unload, vacuum, pre-injection, and quick dump features remain the same as shown in FIG. 1. Other embodiments may feature four, five, six, or more PCUs in the system.

Additionally, the First 90, Second 100, and optionally Third 120 and Fourth 128 Slurry Tanks may have one or more sensors for measuring one or more properties of the slurry, including density, weight, viscosity, and particle size. Additional sensors may include velocity or pressure sensors in the recirculation or transfer conduits. The one or more sensors may be operably coupled to a processor which is operably coupled to a computer readable storage. The computer readable storage may have a set of computer executable instructions programmed according to one or more algorithms which are capable of instructing the processor to control the motors controlling the PCUs, Apparatus, and Slurry Pumps or the brine water intake 80 based on the parameters measured by the sensors. The processor may be operably linked to these motors or a variable speed drive linked to these motors so that they may be controlled according to the set of computer executable instructions.

The Transportable Solids Containers 125 and 129 are readily available steel vessels designed to hold wet and/or dry solids discharged from PCU 2 115 and PCU 3 127 for transport offsite. In some embodiments, a very small percentage of the solids entering the facility reach the Transportable Solids Containers 125 and 129. These particles are generally those resistant to breakdown in the system. However, in other embodiments, if incoming tanker volumes prohibit extra processing through the grinder then they are sent directly to PCU2 115 and ultimately to the transportable solids container 125. This allows for much higher volume processing capability.

The Positive Displacement Injection Pump 140 is a readily available engine/motor driven piston pump designed for pumping abrasive fluids at high volumes and pressures. In embodiments, the Positive Displacement Injection Pump has a selected discharge pressure and can handle selected volumes of material. In this implementation the discharge of the pump is applied directly to the Subterranean Injection Zone.

The Deep Disposal Well 145 is a specially permitted disposal specifically chosen such that the Subterranean Injection Zone is properly suited for solids injection. Typical injection zones are loose, sandy formations. A given Deep Disposal Well 145 may have one or more injection zones deep within the earth of an interval of hundreds to thousands of feet.

Dilution Brine Water 80 is typically produced water or flowback water from oil and/or gas wells throughout the surrounding areas. For convenience, typically the Slurry Processing facility can be built adjacent to a Salt Water Disposal facility so that brine water is readily available. Dilution Brine Water 80 is used throughout the facility to aid in particle size classification and/or to vary the percent solids concentration at various points in the process.

In embodiments, the Bypass 75 is a common header that allows fluids to be sent to either PCU 1 and PCU2 or any one or more or all three PCUs. The operator decides which PCU to send fluids to based on their assessment of particle size reduction susceptibility. If the incoming fluid has solids that are troublesome, such as Frac Sand, then fluid is sent to the directly to PCU2 115 (and/or optionally PCU3 127) and ultimately to the transportable solids container 125. Otherwise it is sent to the first PCU 85 where larger particles are ground up via the Apparatus 95. In embodiments, additional PCUs may be incorporated into the system as needed. It may be used as a redundant flow path for maintenance or in situations where it is not desirable or necessary to pass incoming solids through PCU 85 and/or Grinder 95.

The system may further include an optional Quick Dump Tank 65. Quick Dump Tank 65 is a large vessel or multitude of vessels that provide surge volume in the event overall incoming fluid volumes exceed the capacity of the PCUs. It can also be used in situations where system fluid handling capabilities are reduced due to maintenance or component failure downstream. The tank contains several rotary agitators with paddle blades to allow for the continuous mixture of fluids to keep solids in suspension if so desired. Quick Dump Tank 65 is operably connected to pump 70 which can feed fluids back into the system.

The system may further include an optional Pre-Injection Tank 130. Pre-Injection Tank 130 is a large vessel or multitude of vessels that provide surge volume in the event overall outgoing fluid volumes exceed the capacity of the Positive Displacement Injection Pump 140. Pre-Injection Tank may be operably connected to Positive Displacement Injection Pump 140 through transfer conduit 137. It can also be used in situations where system fluid handling capabilities are reduced due to maintenance or component failure downstream. The tank contains several rotary agitators with paddle blades to allow for the continuous mixture of fluids to keep solids in suspension if so desired. Chemicals may be added to this tank to alter fluid characteristics for improved injectability. Fluids are moved from Pre-Injection Tank 130 to Positive Displacement Injection Pump 140 through pump 135.

Recirculation circuits 107, 109, 111, 112, transfer conduit 113, bypass conduit 75, and other conduits may be implemented through HDPE, steel, iron, stainless steel, PVC pipe, or other types of piping known in the art. Further, a skilled artisan will recognize that alternative arrangements and configurations or different equipment from what is shown in FIGS. 1-4 fall within the scope of the invention, including a less or greater number of components or circuits as depicted. Selection of a specific configuration or equipment depends upon many factors which vary with each waste being processed and the characteristics of the well or subterranean formation.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A method of processing oil field waste for re-injection, the method comprising:

(i) receiving waste from an oil field waste source, the waste including first solid particles and second solid particles;

(ii) separating the waste through a first particle size separator;

wherein the first solid particles having a particle size smaller than a particle size threshold, are transferred to a first slurry tank, combined with fluid to form a first slurry, and at least a portion of the first slurry is removed and re-circulated back into the first slurry tank at a velocity sufficient for reducing particle size upon impact of the first solid particles with the first slurry tank as the first slurry is re-circulated;

wherein the second solid particles having a size larger than the particle size threshold, are transferred to a particle size reduction apparatus, reduced in size, transferred to a second slurry tank, combined with fluid to form a second slurry, and at least a portion of the second slurry is removed and re-circulated back into the second slurry tank and, at a velocity sufficient for reducing particle size upon impact of the second solid particles with the second slurry tank as the second slurry is recirculated;

(iii) removing at least a portion of slurry from the first slurry tank to create first slurry tank removed slurry and transferring the first slurry tank removed slurry to a second particle size separator; and (iv) separating the first slurry tank removed slurry into (a) waste solids having a particle size larger than the particle size threshold and into (b) a re-injection slurry comprising particles with a particle size smaller than the particle size threshold.

2. The method of claim 1, wherein a portion of the second slurry is re-circulated back to the first separator.

3. The method of claim 1, wherein the waste solids having a particle size larger than the particle size threshold are transferred to a transportable container.

4. The method of claim 1, wherein the fluid to form the first slurry is selected from the group consisting essentially of water and brine.

5. The method of claim 1, wherein the waste from the oil field waste source is transferred to the second particle size separator without being processed through the first particle size separator.

6. The method of claim 1, wherein the particle size threshold of the first particle size separator and the particle size threshold of the second particle size separator, are in the range of 200 to 500 μm.

7. The method of claim 1, wherein at least a portion of the re-injection slurry is transferred to a positive displacement injection pump capable of pumping the portion of the re-injection slurry into a subterranean injection zone.

8. The method of claim 7, wherein some or all of the re-injection slurry is transferred to a surge volume tank when capacity of the positive displacement injection pump is exceeded or wherein some or all of the oil field waste is transferred to a surge volume tank when capacity of the first separator is exceeded.

9. The method of claim 1, wherein dilution brine water is transferred to at least one of a group consisting essentially of the first separator, the second separator, and the second slurry tank.

10. The method of claim 1, wherein the oil field waste source is an oil field tanker truck or a frac tank.

11. The method of claim 10, wherein the oil field waste from the oil field tanker truck or frac tank is diluted with a washout fluid and removed from the oil field tanker truck or frac tank by negative pressure.

12. The method of claim 11, wherein the negative pressure is produced by a vacuum conveyance system comprising:

a vacuum vessel capable of receiving washout waste;

a vacuum pump operably connected to the vacuum vessel and capable of producing negative pressure within the vacuum vessel; and a transfer pump operably connected to the vacuum vessel and capable of transferring washout waste out of the vacuum vessel through positive pressure.

13. The method of claim 1, wherein the particle size reduction apparatus is selected from the group consisting essentially of a grinder, rotary blade crusher, ball mill, and hammer mill.

14. The method of claim 1, wherein waste from the oil field waste source is transferred to the second particle size separator and/or a third particle size separator when waste volume exceeds the capacity of the first particle size separator.

15. The method of claim 14, wherein the second particle size separator and third particle size separator separate waste or slurry into (a) waste solids having a particle size larger than the particle size threshold of the second particle size separator and third particle size separator and into (b) a re-injection slurry comprising particles with a particle size smaller than the particle size threshold of the second particle size separator and third particle size separator.

16. The method of claim 15, wherein the waste solids having a particle size larger than the particle size threshold of the second particle size separator and third particle size separator are transferred to a transportable solids container in communication with the second particle size separator and the third particle size separator.

17. The method of claim 1, wherein slurry from the second slurry tank is transferred to the second particle size separator and/or a third particle size separator.

18. The method of claim 1, further comprising a third particle separator, wherein both the second particle separator and third particle separator are operably connected to the first slurry tank.

19. A system for processing oil field waste comprising:

the oil field waste contained in a tank and comprising solid waste, oil-based mud, water-based mud, drill cuttings, crude oil sludge, cement residue, contaminated soil, and production tank bottoms;

a vacuum vessel sized to hold several hundred barrels of liquid oil field waste, and a high volume vacuum pump connected to the tank said high volume vacuum pump is capable of producing negative pressure within the vacuum vessel; and;

a first particle separator positioned downstream of the vacuum vessel and a second particle separator positioned downstream of the first particle separator;

a first slurry tank and a second slurry tank; and a particle size reduction apparatus;

a first pump and a second pump;

a first recirculation circuit and a second recirculation circuit and a transfer conduit;

wherein:

the first particle separator is operably connected to the particle size reduction apparatus and the first slurry tank;

the particle size reduction apparatus is operably connected to the second slurry tank;

the first pump is connected with the first slurry tank and the second particle separator in a manner to provide for re-circulation of slurry back into the first slurry tank through the first recirculation circuit and to transfer slurry to the second particle separator from the first slurry tank through the transfer conduit;

the second pump is connected with the second slurry tank, the first particle separator, and the particle size reduction apparatus in a manner to provide for re-circulation of slurry back into at least one of the second slurry tank, the first particle separator, and the particle size reduction apparatus through the second recirculation circuit.

20. The system of claim 19, wherein the first and second separator each comprise at least one vibratory mesh screen.

21. The system of claim 19, further comprising a positive displacement injection pump, wherein the second separator is operably connected to the first slurry tank and the positive displacement injection pump is operably connected to the first slurry tank.

22. The system of claim 19, further comprising:

a transfer pump operably connected to the vacuum vessel and capable of transferring the oil field waste out of the vacuum vessel through positive pressure.

23. The system of claim 19, further comprising brine water and a brine water transfer conduit configured for transferring brine water to at least one of the first separator, second separator, and second tank.

24. The system of claim 19, wherein the system is contained on a vehicle.

25. A system for processing oil field waste for re-injection, comprising:

a first particle separator and a second particle separator;

a first slurry tank, a second slurry tank, and a third slurry tank;

a particle size reduction apparatus;

a first pump and a second pump;

a first recirculation circuit and a second recirculation circuit and a transfer conduit;

wherein:

the first particle separator is operably connected to the particle size reduction apparatus and the first slurry tank;

the particle size reduction apparatus is operably connected to the second slurry tank;

the second particle separator is operably connected to the third slurry tank;

the first pump is connected with the first slurry tank and the second particle separator in a manner to provide for re-circulation of slurry back into the first slurry tank through the first recirculation circuit and to transfer slurry to the second particle separator from the first slurry tank through the transfer conduit;

the second pump is connected with the second slurry tank, the first particle separator, and the particle size reduction apparatus in a manner to provide for re-circulation of slurry back into the second slurry tank, the first particle separator, or the particle size reduction apparatus through the second recirculation circuit;

wherein a portion of slurry from the first slurry tank is transferred to the second particle separator and is separated through the second particle separator based on the particle size threshold of the second particle separator, wherein solid particles having a size below the particle size threshold of the second separator are transferred to the third slurry tank, and solid particles having a size above the particle size threshold are transferred to a transportable container.

26. The system of claim 25, further comprising:

a washout fluid source, wherein washout fluid from the washout fluid source is pumped into the interior of a tank to produce a washout waste;

a vacuum vessel capable of receiving the washout waste;

a vacuum pump operably connected to the vacuum vessel and capable of producing negative pressure within the vacuum vessel;

a transfer pump operably connected to the vacuum vessel and capable of transferring the washout waste out of the vacuum vessel through positive pressure; and wherein the washout waste is transferred from the vacuum vessel to a magnetic filter capable of removing ferrous materials through magnetic attraction.

27. The system of claim 25 wherein the first particle separator is a vibratory shaker having internal screens with predetermined mesh sizes.

28. The system of claim 25 further comprising a filter vessel that contains a magnetic filter grating assembly to remove ferrous materials.

29. The system of claim 25 wherein the particle size reduction apparatus is selected from the group consisting essentially of a grinder, rotary blade crusher, ball mill, and hammer mill.

30. The system of claim 25 further comprising a third particle separator and a fourth slurry tank, wherein the third particle size separator separate waste or slurry into (a) waste solids having a particle size larger than the particle size threshold of the second particle size separator and third particle size separator and into (b) a re-injection slurry comprising particles with a particle size smaller than the particle size threshold of the second particle size separator and third particle size separator.

31. The system of claim 30 wherein at least a portion of the re-injection slurry is transferred to a positive displacement injection pump capable of pumping the portion of the re-injection slurry into a subterranean injection zone.

32. The system of claim 25 further comprising a sensor for measuring one or more properties of the slurry, including density, weight, viscosity, and particle size.

33. The system of claim 32 further comprising a processor operably linked to a motor that may be controlled according to a set of computer executable instructions.

* * * * *